US007467858B2

(12) United States Patent
Lebron et al.

(10) Patent No.: US 7,467,858 B2
(45) Date of Patent: Dec. 23, 2008

(54) BACK PRESSURE CONTROL IN INKJET PRINTING

(75) Inventors: Hector J. Lebron, San Diego, CA (US); Clayton L. Holstun, San Marcos, CA (US); Dustin W. Blair, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 197 days.

(21) Appl. No.: 11/248,907

(22) Filed: Oct. 12, 2005

(65) Prior Publication Data

US 2007/0081052 A1 Apr. 12, 2007

(51) Int. Cl.
*B41J 2/175* (2006.01)

(52) U.S. Cl. ..... 347/85

(58) Field of Classification Search ..... 347/5, 347/84, 85, 87; 141/2, 18
See application file for complete search history.

(56) References Cited

U.S. PATENT DOCUMENTS 4,651,161 A 3/1987 Rich et al.
4,700,205 A 10/1987 Rich et al.
4,791,438 A 12/1988 Hanson et al.
4,920,362 A 4/1990 Cowger
5,489,925 A 2/1996 Brooks et al.
5,646,666 A 7/1997 Cowger et al.
5,856,838 A * 1/1999 Oda et al. ..... 347/85
5,880,748 A 3/1999 Childers et al.
6,428,156 B1 8/2002 Waller et al.
6,840,605 B2 1/2005 Hauck
6,874,872 B2 4/2005 Lewis et al.
6,883,905 B2 * 4/2005 Kimura et al. ..... 347/85
7,207,648 B2 * 4/2007 Kojima et al. ..... 347/22

* cited by examiner

*Primary Examiner*—Anh T. N. Vo

(57) ABSTRACT

A method of inkjet printing includes establishing a back pressure corresponding to a desired print mode in a printhead and changing the back pressure in response to changes in print mode. A printing system for printing in a number of distinct print modes includes an inkjet pen having a printhead and a back pressure control unit having multiple back pressure settings. The back pressure is set to a first value when the printing system is operating in a first print mode to a second value when the printing system is operating in a second print mode. In another embodiment, the printing system includes structure for controlling meniscus condition in the printhead nozzles by selectively changing back pressure.

24 Claims, 7 Drawing Sheets

BACK PRESSURE CONTROL IN INKJET PRINTING

BACKGROUND OF THE INVENTION

This invention relates generally to inkjet printing and more particularly to controlling back pressure in inkjet printing systems.

Inkjet printing technology is used in many commercial products such as computer printers, graphics plotters, copiers, and facsimile machines. One type of inkjet printing known as "drop on demand" employs a pen that ejects drops of ink onto a print medium such as a sheet of paper. The pen is typically mounted to a reciprocating carriage that traverses back-and-forth across the print medium. As the pen is moved repeatedly across the print medium, it is activated under command of a controller to eject drops of ink at appropriate times. With proper selection and timing of the drops, the desired pattern is obtained on the print medium.

The pen includes a drop-generating device known as a printhead, which has a plurality of nozzles or orifices through which the drops of ink are ejected. Adjacent to each nozzle is a firing chamber that contains the ink to be ejected through the nozzle. Ejection of an ink drop through a nozzle may be accomplished using any suitable ejection mechanism, such as thermal bubble or piezoelectric pressure wave to name a few. Ink is delivered to the firing chambers from an ink feed hole that is in fluid communication with an ink supply. The ink supply can be wholly contained within the pen body to form a print cartridge. Such an ink supply is considered to be "on-board." In other cases, the ink supply can comprise an internal chamber that is fluidly coupled to a remote ink reservoir via one or more ink transfer conduits. These particular systems are conventionally known as "off-axis" printing units.

With drop on demand printing systems, a slight back pressure (i.e., a less-than-atmospheric or negative gauge pressure) is established within the printhead so that ink will be retained until deliberately ejected. The back pressure is set to be sufficient to prevent ink from leaking or "drooling" out of the nozzles between periods of active ink ejection but not so great so as to draw air into the printhead through the nozzles or to impede the rapid refilling of ink into the firing chambers. Printheads often include a pressure regulator that functions to maintain a preset back pressure.

It is often desirable to enable a printing system to operate in a variety of "print modes." A print mode is the set of operating parameters, including the maximum drop firing frequency and printhead scanning method, that define a particular printing process. For instance, high frequency, single-pass, bi-directional printing is the fastest print mode but can be sensitive to missing or misdirected nozzles, ink bleed, and the like. Thus, for some print jobs, it may be desirable to select a slower print mode (e.g., a low frequency, multi-pass mode) to improve print quality. Print modes are generally chosen on a job-by-job basis depending on factors such as print media selection, content to be printed and desired print quality, but print modes can also be changed on a page-by-page, or even line-by-line, basis based on local content changes within the printed page.

The maximum drop firing frequency of,a printhead design depends on how rapidly the firing chamber can be refilled after a drop is ejected. The faster the chamber can be refilled, the sooner another drop can be ejected through the nozzle. As the firing chamber is filled with liquid ink, the ink forms a meniscus in the corresponding nozzle. The meniscus behaves like a naturally damped membrane that seeks equilibrium undergoing simple harmonic oscillations. At equilibrium, a constant volume of ink is present. However, before equilibrium is reached (i.e., while the meniscus is still oscillating), the ink volume will also be oscillating. Thus, if the firing frequency is such that drops are being ejected while the meniscus is oscillating, the drops can vary in weight and velocity. Additionally, the shape of an ejected drop and how quickly it breaks up into smaller drops will change as the meniscus position changes. For example, if a drop is ejected when the meniscus is on a maximum excursion (bulging out), the resulting drop will have a higher drop weight and a lower drop velocity. Such drop variation results in print quality issues. Damping, or reducing the fluidic natural frequency of the design, can reduce meniscus oscillations and drop variation problems but will result in a lower maximum firing frequency. Pen architecture designs optimized for high frequency performance are under-damped to allow for refill at high flow rates. However, such designs will experience significant meniscus overshoot, oscillation and drop size and shape variation when operating at mid-level frequencies. One solution has been to simply avoid print modes that use firing frequencies residing in the maximum overshoot frequency range. However, this severely restricts the ability to select from a wide range of print modes.

SUMMARY OF THE INVENTION

In one embodiment, the present invention provides a method of inkjet printing in a number of distinct print modes. The method includes providing a printhead and supplying ink to the printhead. The method further includes establishing a back pressure corresponding to a desired print mode in the printhead and changing the back pressure in response to a change in print mode.

In another embodiment, the present invention provides a printing system comprising an ink supply and a printhead having a plurality of ink ejection nozzles fluidly connected to the ink supply. The printing system includes means for controlling meniscus condition (i.e., meniscus overshoot and/or meniscus location) in the nozzles by selectively changing back pressure in the printhead.

In yet another embodiment, the present invention provides a printing system capable of operating in a number of distinct print modes. The printing system includes an ink supply and an inkjet pen including a printhead in fluid communication with the ink supply. Also provided is a means for setting back pressure in the printhead. The back pressure is set to a first value when the printing system is operating in a first print mode to a second value when the printing system is operating in a second print mode.

In still another embodiment, the present invention provides an inkjet pen having a body defining an ink reservoir and a printhead mounted to an outer surface of the body in fluid communication with the ink reservoir. A back pressure control unit having multiple back pressure settings is located in the body.

The present invention and its advantages over the prior art will be more readily understood upon reading the following detailed description and the appended claims with reference to the accompanying drawings.

DESCRIPTION OF THE DRAWINGS

The subject matter that is regarded as the invention is particularly pointed out and distinctly claimed in the concluding part of the specification. The invention, however, may be best understood by reference to the following description taken in conjunction with the accompanying drawing figures in which:

DETAILED DESCRIPTION OF THE INVENTION

Figure 1:
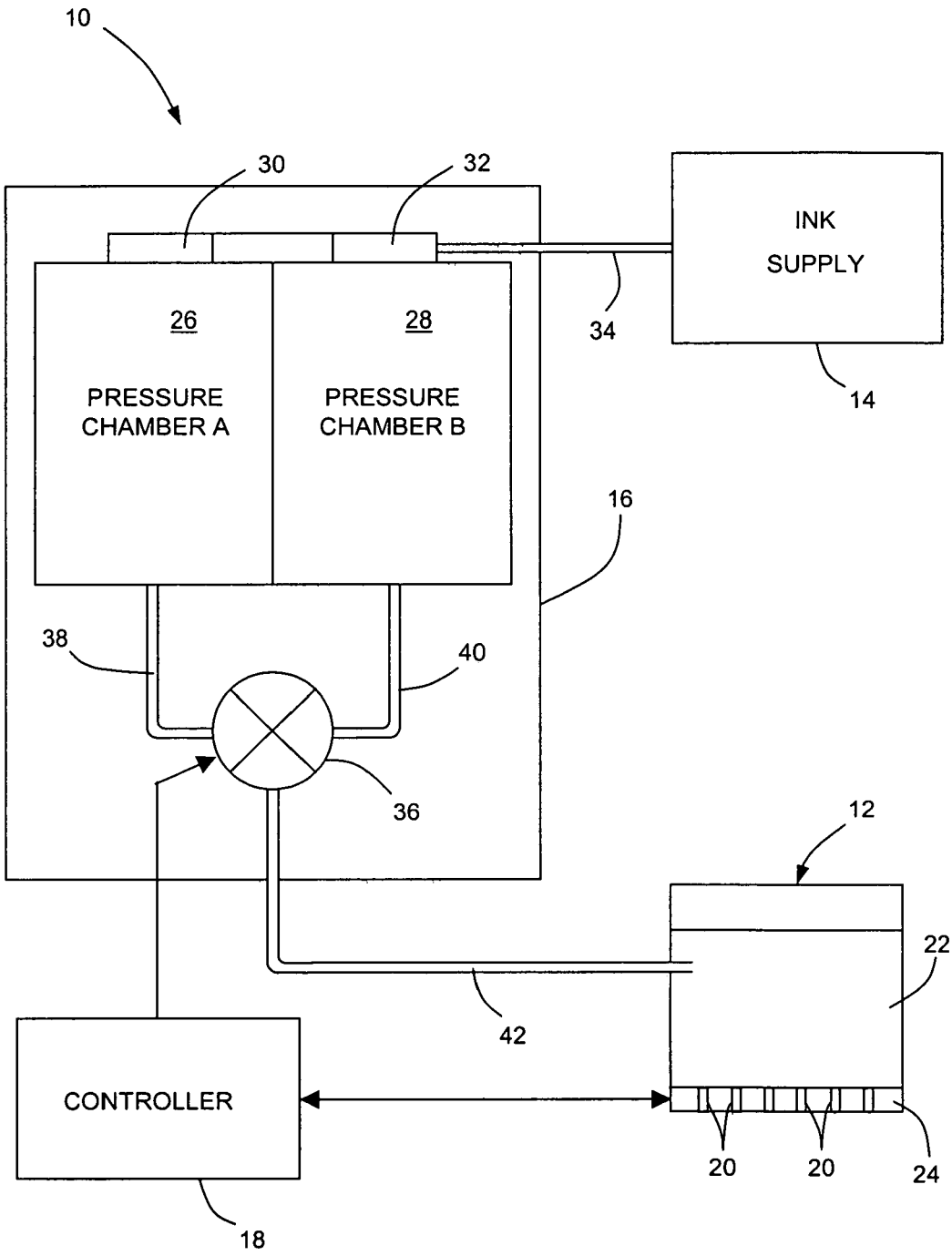
FIG. 1 is a schematic representation of a first embodiment of an inkjet printing system.

Referring to the drawings wherein identical reference numerals denote the same elements throughout the various views, FIG. 1 shows one embodiment of an inkjet printing system 10. The printing system 10 includes an inkjet pen 12, an ink supply 14, a back pressure control unit 16, and a controller 18, which can be any conventional print controller used in printing systems. The pen 12 includes a pen body that contains an internal ink reservoir 22 for holding a quantity of ink. A printhead 24 having a plurality of ink ejection nozzles 20 formed therein is mounted on an outer surface of the pen body and is in fluid communication with the internal ink reservoir 22. Although only a relatively small number of nozzles 20 is shown in FIG. 1, the printhead 24 may have hundreds of nozzles, as is common in the printhead art. The printhead 24 includes an ink drop generator (not shown in FIG. 1) subjacent each nozzle 20. The printhead 24 is controlled by the controller 18 to eject droplets of ink from the reservoir 22 through the nozzles 20. The pen 12 is mounted to a carriage or similar means (not shown) for being traversed back and forth over a print medium.

The internal reservoir 22 of the pen 12 receives ink from the ink supply 14 via the back pressure control unit 16. The ink supply 14 is preferably, although not necessarily, pressurized. The back pressure control unit 16 operates to change and selectively set the back pressure in the reservoir 22, and thus in the printhead 24. That is, the back pressure control unit 16 supplies ink to the reservoir 22 at a selected pressure so as to establish the desired back pressure in the reservoir 22 and the printhead 24. To this end, the back pressure control unit 16 includes two pressure chambers 26 and 28. The first pressure chamber 26 is provided with a first pressure regulator 30 calibrated to a first back pressure set point, and the second pressure chamber 28 is provided with a second pressure regulator 32 calibrated to a second back pressure set point. For instance, the first pressure chamber 26 could be set at a gauge pressure of negative 4.5 inches of water, and the second pressure chamber 28 could be set at a gauge pressure of negative 12 inches of water gauge pressure. The first and second pressure regulators 30 and 32 are fluidly connected to the ink supply 14 via an ink supply conduit 34 and operate to admit ink into the corresponding pressure chamber when the pressure in that chamber falls below its set point.

The back pressure control unit 16 further includes a diverter valve 36 connected to the first pressure chamber 26 by a first conduit 38 and connected to the second pressure chamber 28 by a second conduit 40. The diverter valve 36 is also connected to the reservoir 22 by an ink feed conduit 42. The valve 36 is operated under control of the controller 18 to selectively place the reservoir 22 in fluid communication with either one of the two pressure chambers 26 and 28, thereby establishing a back pressure in the reservoir 22 and the printhead 24 that corresponds to the pressure of the selected pressure chamber. Thus, the back pressure control unit 16 provides two different back pressure settings. While the illustrated embodiment shows two pressure chambers for providing two different back pressure settings, it should be noted that the back pressure control unit 16 could include more than two pressure chambers for providing more than two different back pressure settings.

In operation, the performance of the printing system 10 can be adjusted real-time depending on the printing application at hand. For example, the back pressure control unit 16 can set the back pressure in the printhead 24 to a first value when the printing system 10 is operating in a first print mode and to a second value when the printing system 10 is operating in a second print mode. In other words, the back pressure in the printhead 24 can be increased or decreased to adjust printing system performance to different printing modes. Print modes can be changed on a job-by-job basis (i.e., between print jobs) or on a page-by-page, or even line-by-line, basis (i.e., during print jobs).

Changing back pressure in the printhead 24 at a given frequency can affect printing system performance because the change in back pressure will have an effect on the degree of meniscus overshoot. Namely, using a greater back pressure produces a more damped system with less meniscus overshoot. (Note that as used herein, "greater back pressure" means a more negative gauge pressure, and thus a lower pressure value, while "lesser back pressure" means a less negative gauge pressure, and thus a higher pressure value.) Changing back pressure can also affect the meniscus location (i.e., the position of the meniscus in the nozzle). Accordingly, as used herein "controlling meniscus condition" refers to controlling meniscus overshoot and/or meniscus location.

Figure 2:
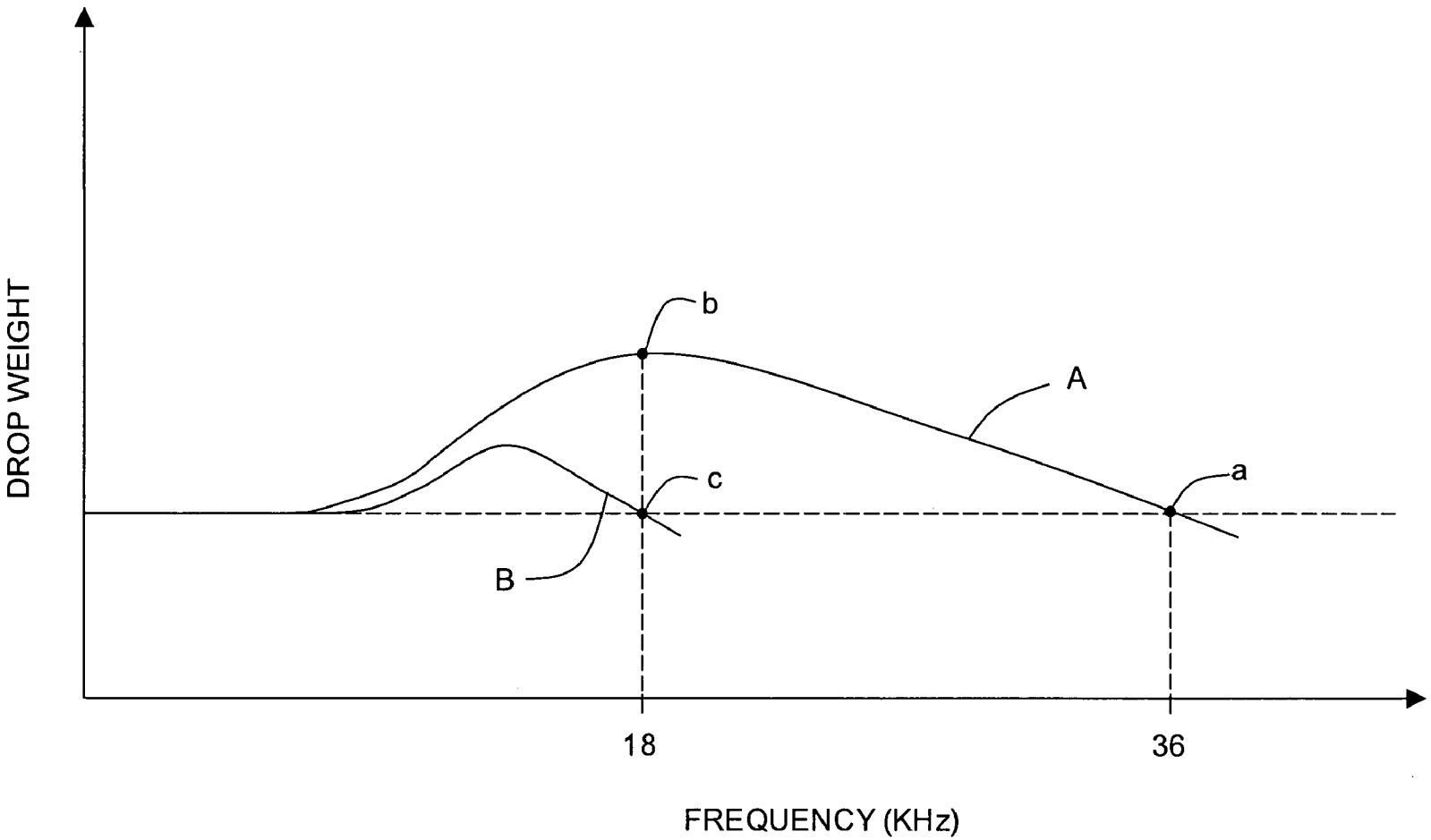
FIG. 2 is a graph plotting drop weight against firing frequency for two different back pressure settings.

An example of how different back pressures can affect performance for two print modes having different firing frequencies is illustrated graphically in FIG. 2, which is a graph plotting ejected drop weight as a function of firing frequency when the back pressure is set at negative 4.5 inches of water (curve A) and at negative 12 inches of water (curve B). In both cases, the drop weight is constant at low frequencies (below 10 KHz in the illustrated example) and then begins to increase, reaching a maximum drop weight at a mid-level frequency before dropping off again at higher frequencies. In the illustrated example, curve A reaches a maximum drop weight at about 18 KHz and curve B reaches a maximum drop weight at about 15 KHz. Assume for the sake of this example that the printing system 10 is capable of operating in at least two print modes: a first print mode in which the printing system 10 operates at a high maximum frequency such as 36 KHz and a second print mode in which the printing system 10 operates at a lower maximum frequency such as 18 KHz. When the printing system 10 is operated in the first print mode (36 KHz) with the back pressure control unit 16 set at negative 4.5 inches of water, the degree of meniscus overshoot is tolerated (in this fast mode) and the meniscus has time to return to its equilibrium position before firing again. The drop weight is at a desired level at 36 kHz (see point a). If the printing system 10 is switched to the second print mode (18 KHz) while the back pressure control unit 16 is still set at negative 4.5 inches of water, then the system will be firing when the meniscus is in a significantly distended position (see point b), and drop shape and print quality will be negatively affected. However, switching the back pressure control unit 16 to negative 12 inches of water, thereby increasing the back pressure in the printhead 24, while operating in the second print mode reduces the meniscus overshoot to a lesser, acceptable amount such that the drop weight and drop shape (see point c) produces good print quality. Further, this more highly damped system will have less tendency to form puddles, which can cause drop misdirection and drop shape problems.

This active control of back pressure allows system performance to be optimized for a number of print modes with a single pen design. Lower back pressure levels provide underdamped performance that maximizes printing speed for fast or draft modes. Although sacrificing speed, higher back pressure minimizes meniscus overshoot, thereby minimizing puddling and directionality errors and is therefore ideal for best mode printing. If more than two back pressure settings are available, intermediate levels of back pressure can be used to optimize printing at all modes in between these extremes. Active control of back pressure can also be used to modulate the drop weight the pen delivers at a given frequency (in some instances it is desirable to provide different drop weights) and allow for system tuning when different rheology (viscosity, surface tension, etc.) inks are to be used with the same printhead architecture.

Figure 3:
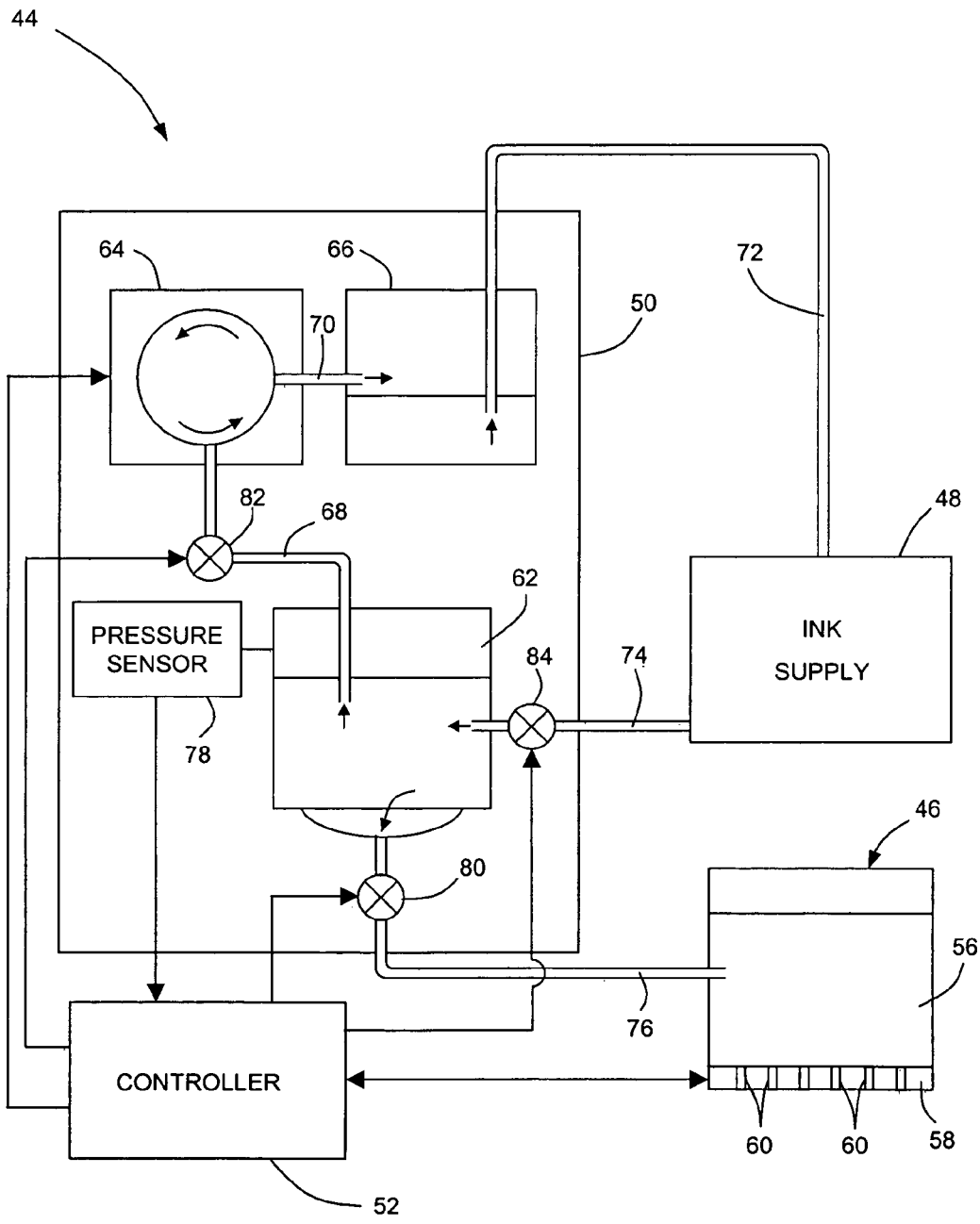
FIG. 3 is a schematic representation of a second embodiment of an inkjet printing system.

FIG. 3 shows another embodiment of an inkjet printing system 44. The printing system 44 includes an inkjet pen 46, an ink supply 48, a back pressure control unit 50, and a controller 52, which can be any conventional print controller used in printing systems. As in the first embodiment described above, the pen 46 includes a pen body that contains an internal ink reservoir 56 and a printhead 58 mounted on an outer surface of the pen body in fluid communication with the ink reservoir 56. The printhead 58 includes a plurality of ink ejection nozzles 60 formed therein.

The internal reservoir 56 receives ink from the ink supply 48 via the back pressure control unit 50. The ink supply 48 is preferably, although not necessarily, pressurized. The back pressure control unit 50 operates to change and selectively set the back pressure in the reservoir 56, and thus in the printhead 58. That is, the back pressure control unit 50 supplies ink to the reservoir 56 at a selected pressure so as to establish the desired back pressure in the reservoir 56 and the printhead 58. In this embodiment, the back pressure control unit 50 includes a single pressure chamber 62 maintained at a variable back pressure, a pump 64, and an ink return staging tank 66. The pump 64, which can be a viscous effect pump, is arranged to pump ink from the pressure chamber 62 through a first conduit 68, thereby lowering pressure (i.e., increasing back pressure) in the pressure chamber 62. Ink removed from the pressure chamber 62 by the pump 64 is fed to the ink return staging tank 66 by a second conduit 70. Ink in the ink return staging tank 66 is delivered to the ink supply 48 via a third conduit 72. When needed, ink is fed from the ink supply 48 to the pressure chamber 62 via an ink supply conduit 74. The pressure chamber 62 is connected to the reservoir 56 by an ink feed conduit 76. A pressure sensor 78 is provided for detecting the pressure in the pressure chamber 62 and providing a signal thereof to the controller 52.

The back pressure control unit 50 further includes first, second and third control valves 80, 82, 84 that are used in conjunction (under command of the controller 52) to control ink flow and regulate back pressure in the pressure chamber 62. The first control valve 80 is positioned in the ink feed conduit 76 between the pressure chamber 62 and the reservoir 56, the second control valve 82 is positioned in the first conduit 68 between the pressure chamber 62 and the pump 64, and the third control valve 84 is positioned in the ink supply conduit 74 between the pressure chamber 62 and the ink supply 48.

With this arrangement, the back pressure control unit 50 will function to maintain the back pressure in the printhead 58 at the desired setting. As the printhead 58 consumes ink, more ink will be fed to the printhead 58 from the pressure chamber 62 because the first control valve 80will be open while the system is actively printing. In response, the controller 52 will open the third control valve 84 so to deliver an appropriate replacement volume of ink to the pressure chamber 62 from the ink supply 48, and thereby maintain the back pressure in the pressure chamber 62 at the desired level as sensed by the pressure sensor 78. When it is desired to change the back pressure in the printhead 58, the controller 52 will operate the control valves and the pump 64 as needed to effect the desired change. To increase back pressure, the second control valve 82 will be opened and the pump 64 will be activated to remove ink from the pressure chamber 62 and thereby increase back pressure. When the new desired back pressure is reached, this will be detected by the pressure sensor 78, and the controller 52 will inactivate the pump 64. To decrease back pressure, the third control valve 84 will be opened to allow ink from the ink supply 48 to flow into pressure chamber 62, thereby decreasing the back pressure. The pressure sensor 78 will detect when the desired back pressure is attained, and the controller 52 will then cause the third control valve 84 to be shut. Thus, the back pressure control unit 50 provides a wide range of possible back pressure settings.

Figure 4:
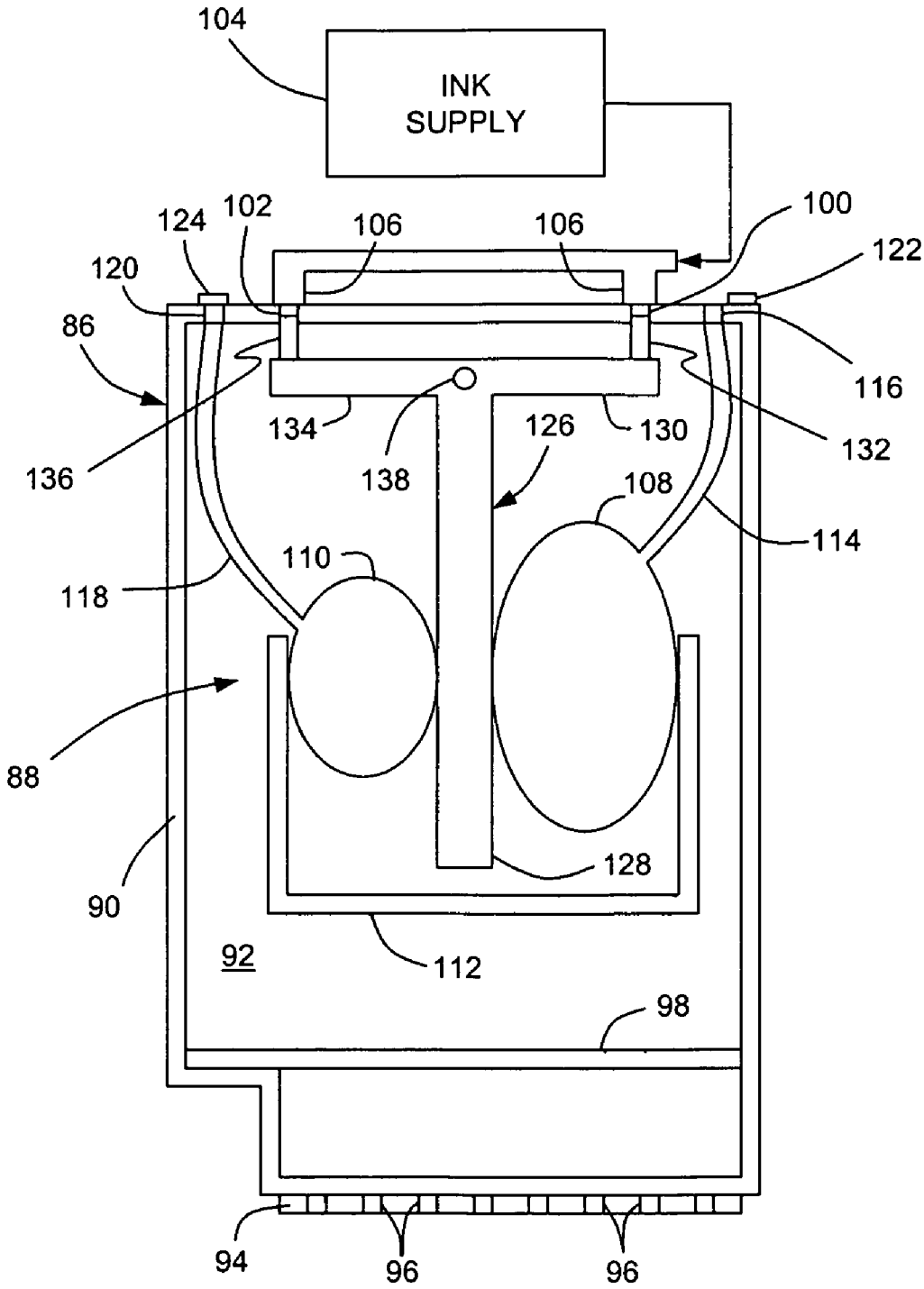
FIG. 4 is a cross-section view of an inkjet pen having one embodiment of a back pressure control unit.

In the printing system embodiments described above, the back pressure control unit is located remote from the pen. Having the pressure control mechanism located off-axis reduces pen module cost, thereby reducing customer supply costs. However, it is also possible to provide an inkjet printing system in which means for controlling back pressure are included with the pen. FIG. 4 shows one embodiment of an inkjet pen 86 having an internal back pressure control unit 88 that provides multiple back pressure settings. The pen 86 includes a pen body 90 that defines a local ink reservoir 92 therein for holding a quantity of ink. A printhead 94 having a plurality of ink ejection nozzles 96 formed therein is mounted on an outer surface of the pen body 90 in fluid communication with the reservoir 92. A fluid screen 98 is positioned near the printhead 94 to filter out particles in the ink and prevent the printhead 94 from clogging. The pen body 90 includes first and second ink inlets 100 and 102 for selectively admitting ink, under control of the back pressure control unit 88, into the local reservoir 92 from a remote ink supply 104 via ink supply conduits 106.

The back pressure control unit 88 includes first and second air bags or "bagophragms" 108 and 110 situated within a U-shaped frame 112 mounted inside the pen body 90. The air bags 108 and 110 are preferably made of a thin, high-barrier material that is flexible and non-elastic. The first air bag 108 is vented to the atmosphere outside of the pen body 90 through first tubing 114 and a first air vent 116 formed in the pen body 90. The second air bag 110 is vented to the atmosphere outside of the pen body 90 through second tubing 118 and a second air vent 120 formed in the pen body 90. First and second sliding air seals 122 and 124 are provided on the outer surface of the pen body 90 for selectively closing the air vents 116 and 120, respectively. The air seals 122 and 124 operate so that only one of the two air bags 108, 110 at a time is vented to atmosphere. In other words, when the first air bag 108 is vented, the second air bag 110 is closed (as shown in FIG. 4), and when the second air bag 110 is vented, the first air bag 108 is closed. The airbag that is vented to atmosphere is allowed to expand or contract in response to pressure changes in the pen 86.

The back pressure control unit 88 further includes a T-shaped valve lever 126 pivotally mounted inside the pen body 90. The valve lever 126 includes a moment arm 128, a first sealing arm 130 supporting a first ink seal 132, and a second sealing arm 134 supporting a second ink seal 136. The first and second ink seals 132, 136 are preferably made of an elastomer material. The valve lever 126 is mounted to pivot about a pivot axis 138 located at the intersection of the three arms 128, 130, 134. The moment arm 128 is positioned between the first and second air bags 108 and 110, and the first and second sealing arms 130, 134 extend outwardly in opposite directions from the upper end of the moment arms 128 so as to position the first and second ink seals 132, 136 against the first and second ink inlets 100 and 102, respectively, when the valve lever 126 is in its central, equilibrium position as illustrated in FIG. 4.

During operation, the ink level in the reservoir 92 will drop as ink is ejected from the nozzles 96, resulting in a drop in ink pressure (i.e., an increase in back pressure). With the first air vent 116 open, as shown in FIG. 4, the first air bag 108 will expand in response to the decreased ink pressure and exert a force against the moment arm 128. When the ink pressure in the reservoir 92 reaches a preset level, the force exerted on the moment arm 128 by the expanding first air bag 108 will be sufficient to cause the valve lever 126 to rotate in a clockwise (as viewed in FIG. 4) direction, causing the first ink seal 132 to be lifted away from the first ink inlet 100, thereby allowing ink to flow into the reservoir 92. (Note that the second ink seal 136 is able to slide vertically in the second ink inlet 102 while still providing a seal to allow clockwise rotation of the valve lever 126.) This will return the ink pressure to a desired level, the first air bag 108 will contract, and the second air bag 110 will act as a spring, returning the valve lever 126 to its central, equilibrium position so that the first ink seal 132 will close the first ink inlet 100. Conversely, with the second air vent 120 open, the second air bag 110 will expand in response to a drop in ink pressure. The second air bag 110 will exert a force against the moment arm 128 in the opposite direction as the first air bag 108. When the ink pressure in the reservoir 92 reaches a different preset level, the force exerted on the moment arm 128 by the expanding second air bag 110 will be sufficient to cause the valve lever 126 to rotate in a counterclockwise (as viewed in FIG. 4) direction causing the second ink seal 136 to be lifted away from the second ink inlet 102, thereby allowing ink to flow into the reservoir 92. (Note that the first ink seal 132 is able to slide vertically in the first ink inlet 100 while still providing a seal to allow counterclockwise rotation of the valve lever 126.) This will return the ink pressure to a different desired level, the second air bag 110 will contract, and the first air bag 108 will act as a spring, returning the valve lever 126 to its central, equilibrium position so that the second ink seal 136 will close the second ink inlet 102.

The back pressure control unit 88 is configured so that each air bag has a different set point or preset pressure level at which ink will be admitted into the reservoir 92. Specifically, the geometry of the back pressure control unit 88 (e.g., the size of the air bags 108, 110 and the relative positions of the air bags 108, 110, the frame 112 and the valve lever 126) is such that there will be two different set points so that the pen 86 will have two different back pressure settings. Which back pressure setting is selected is determined by which one of the two air vents 116 and 120 is open.

Figure 5:
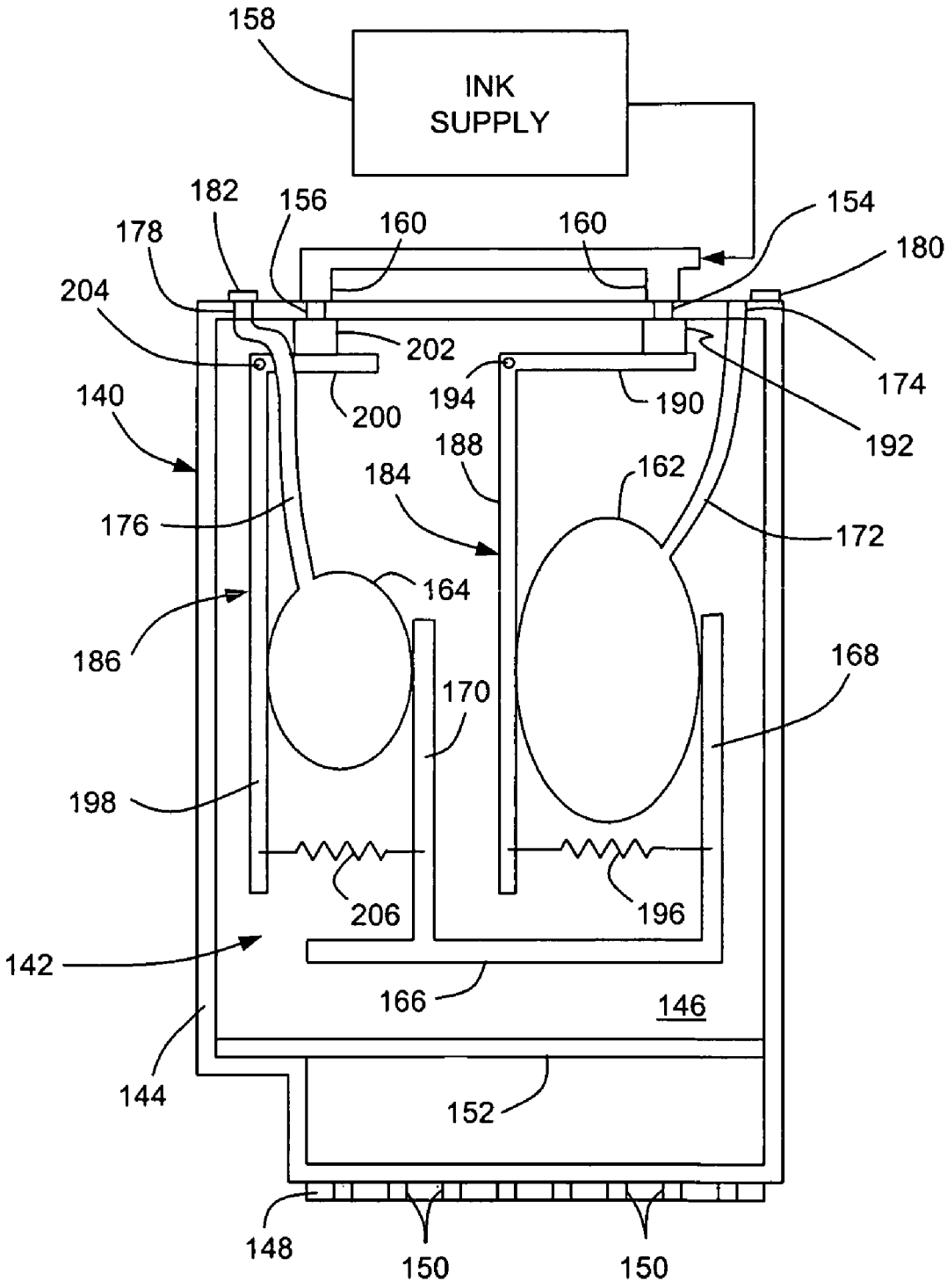
FIG. 5 is a cross-section view of an inkjet pen having another embodiment of a back pressure control unit.

Referring to FIG. 5, an alternative embodiment of an inkjet pen 140 having an internal back pressure control unit 142 that provides multiple back pressure settings is shown. The pen 140 includes a pen body 144 that defines a local ink reservoir 146 therein for holding a quantity of ink. A printhead 148 having a plurality of ink ejection nozzles 150 formed therein is mounted on an outer surface of the pen body 144 in fluid communication with the reservoir 146. A fluid screen 152 is positioned near the printhead 148 to filter out particles in the ink and prevent the printhead 148 from clogging. The pen body 144 includes first and second ink inlets 154 and 156 for selectively admitting ink, under control of the back pressure control unit 142, into the local reservoir 146 from a remote ink supply 158 via ink supply conduits 160.

The back pressure control unit 142 includes first and second air bags or "bagophragms" 162 and 164 and a frame 166 mounted inside the pen body 144. The frame 166 has a first column 168 abutting the first air bag 162 and a second column 170 abutting the second air bag 164. The first air bag 162 is vented to the atmosphere outside of the pen body 144 through first tubing 172 and a first air vent 174 formed in the pen body 144. The second air bag 164 is vented to the atmosphere outside of the pen body 144 through second tubing 176 and a second air vent 178 formed in the pen body 144. First and second sliding air seals 180 and 182 are provided on the outer surface of the pen body 144 for selectively closing the air vents 174 and 178, respectively. The air seals 180 and 182 operate so that only one of the two air bags 162 and 164 at a time is vented to atmosphere. In other words, when the first air bag 162 is vented, the second air bag 164 is closed (as shown in FIG. 5), and when the second air bag 164 is vented, the first air bag 162 is closed. The airbag that is vented to atmosphere is allowed to expand or contract in response to pressure changes in the pen 140.

The back pressure control unit 142 further includes first and second L-shaped valve levers 184 and 186 pivotally mounted inside the pen body 144. The first valve lever 184 includes a first moment arm 188 and a first sealing arm 190 that supports a first ink seal 192. The first valve lever 184 is mounted to pivot about a first pivot axis 194 located at the intersection of the first moment arm 188 and the first sealing arm 190. The first air bag 162 is positioned between the first moment arm 188 and the first column 168, and a first spring 196 is connected between the first moment arm 188 and the first column 168. The first sealing arm 190 extends from the upper end of the first moment arm 188 so as to position the first ink seal 192 against the first ink inlet 154 when the first valve lever 184 is in its central, equilibrium position as illustrated in FIG. 5. The second valve lever 186 includes a second moment arm 198 and a second sealing arm 200 that supports a second ink seal 202. The second valve lever 186 is mounted to pivot about a second pivot axis 204 located at the intersection of the second moment arm 198 and the second sealing arm 200. The second air bag 164 is positioned between the second moment arm 198 and the second column 170, and a second spring 206 is connected between the second moment arm 198 and the second column 170. The second sealing arm 200 extends from the upper end of the second moment arm 198 so as to position the second ink seal 202 against the second ink inlet 156 when the second valve lever 186 is in its central, equilibrium position as illustrated in FIG. 5.

During operation, the ink level in the reservoir 146 will drop as ink is ejected from the nozzles 150, resulting in a drop in ink pressure (i.e., an increase in back pressure). With the first air vent 174 open, as shown in FIG. 5, the first air bag 162 will expand in response to the decreased ink pressure and exert a force against the first moment arm 188. When the ink pressure in the reservoir 146 reaches a preset level, the force exerted on the first moment arm 188 by the expanding first air bag 162 will be sufficient to cause the first valve lever 184 to rotate in a clockwise (as viewed in FIG. 5) direction, causing the first ink seal 192 to be lifted away from the first ink inlet 154, thereby allowing ink to flow into the reservoir 146. This will return the ink pressure to a desired level, the first air bag 162 will contract, and the first spring 196 will return the first valve lever 184 to its central, equilibrium position so that the first ink seal 192 will close the first ink inlet 154. Conversely, with the second air vent 178 open, the second air bag 164 will expand in response to a drop in ink pressure. The second air bag 164 will exert a force against the second moment arm 198. When the ink pressure in the reservoir 146 reaches a different preset level, the force exerted on the second moment arm 198 by the expanding second air bag 164 will be sufficient to cause the second valve lever 186 to rotate in a clockwise (as viewed in FIG. 5) direction, causing the second ink seal 202 to be lifted away from the second ink inlet 156, thereby allowing ink to flow into the reservoir 146. This will return the ink pressure to a different desired level, the second air bag 164 will contract, and the second spring 206 will return the second valve lever 186 to its central, equilibrium position so that the second ink seal 202 will close the second ink inlet 156.

The back pressure control unit 142 is configured so that each air bag has a different set point or preset pressure level at which ink will be admitted into the reservoir 146. Specifically, the geometry of the back pressure control unit 142 (e.g., the size of the air bags 162, 164 and the relative positions of the air bags 162, 164, the columns 168, 170 and the valve levers 184, 186) is such that there will be two different set points so that the pen 140 will have two different back pressure settings. Which back pressure setting is selected is determined by which one of the two air vents 174 and 178 is open.

Figure 6:
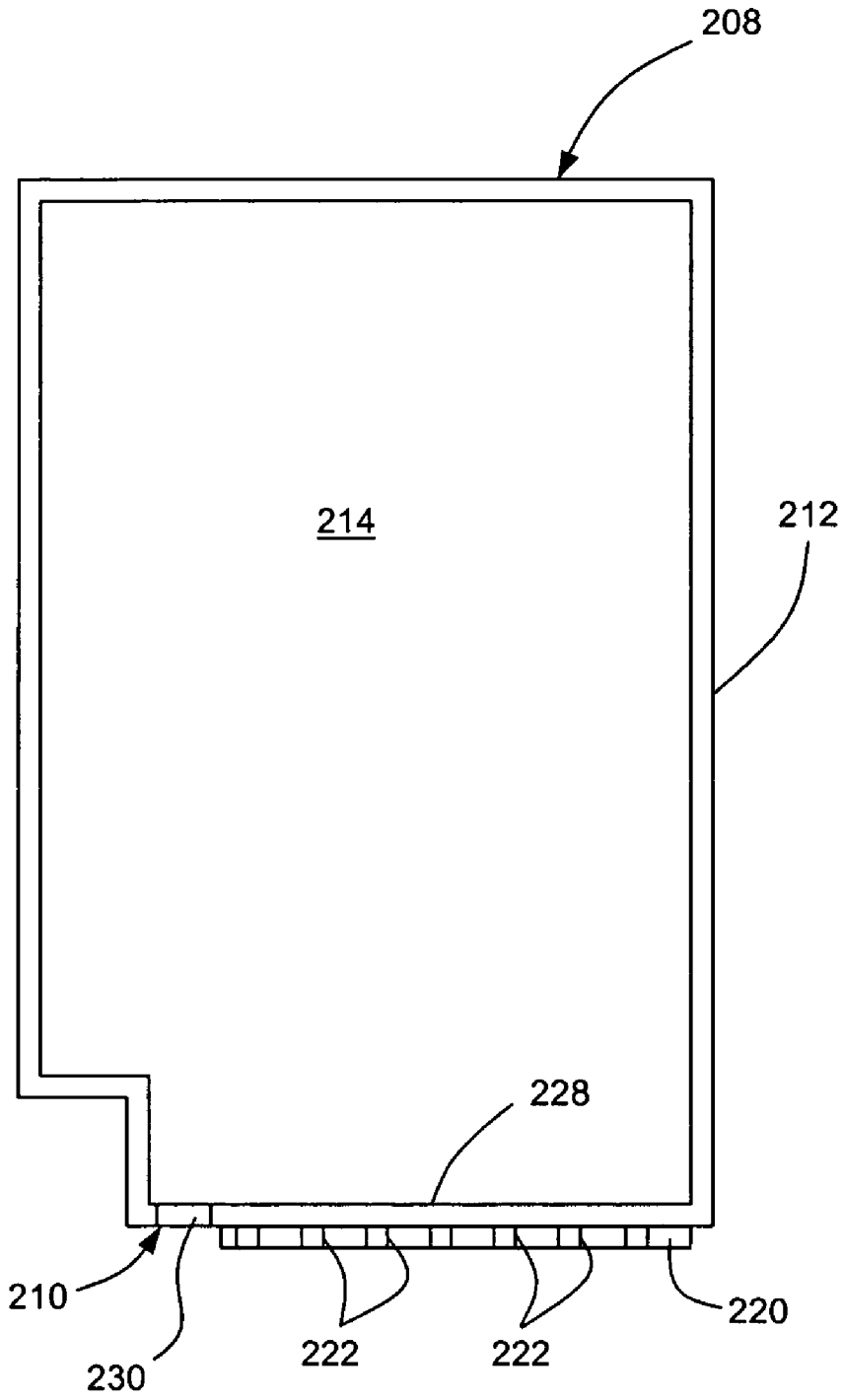
FIG. 6 is a cross-section view of an inkjet pen having yet another embodiment of a back pressure control unit.

FIG. 6 shows yet another embodiment of an inkjet pen 208 having an internal back pressure control unit 210 that provides multiple back pressure settings. The pen 208 includes a pen body 212 that defines an internal ink reservoir 214, which is the system ink supply in this case. A printhead 220 having a plurality of ink ejection nozzles 222 formed therein is mounted on an outer surface of the pen body 212 in fluid communication with the ink reservoir 214.

Figure 7:
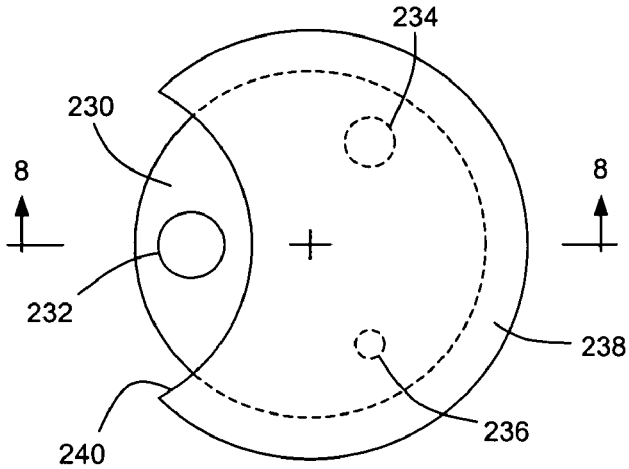
FIG. 7 is a top view of the back pressure control unit of FIG. 6.
Figure 8:
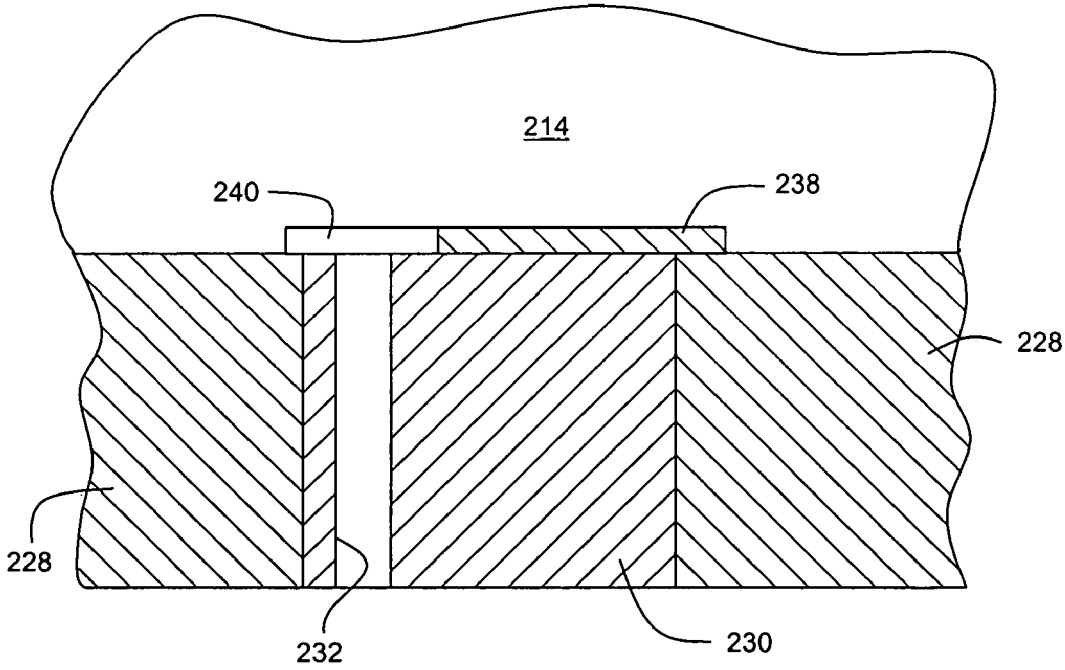
FIG. 8 is a sectional view of the back pressure control unit taken along line 8-8 of FIG. 7.

In this embodiment, the back pressure control unit 210 includes a bubble generator cylinder 230 rotatively mounted in a bottom wall 228 of the pen body 212. As seen in FIGS. 7 and 8, the bubble generator cylinder 230 has a plurality (three in the illustrated example, but more are possible) of orifices 232, 234, 236 extending longitudinally therein. Each orifice 232, 234, 236 has a different diameter. The cylinder 230 rotates about its longitudinal axis and can be selectively positioned so that only one orifice 232, 234, 236 at a time establishes an air path between the ink reservoir 214 and the atmosphere external to the pen body 212. This can be accomplished with a cap 238 positioned on the bottom wall 228 over the upper end of the cylinder 230. The cap 238 has a notch 240 formed therein so that one of the three orifices establishes an air path between the ink reservoir 214 and the atmosphere external to the pen body 212 while the other orifices are blocked by the cap 238. The orifice that is establishing the air path at any given time is referred to as the "active orifice." As shown in FIGS. 7 and 8, the first orifice 232 establishes the air path, and the other two orifices are blocked. If the bubble generator cylinder 230 is rotated counterclockwise 120 degrees, the second orifice 234 will establish the air path, and if the cylinder 230 is rotated counterclockwise another 120 degrees, the third orifice 236 will establish the air path.

In operation, as the printhead 224 ejects ink drops, the depletion of ink from the reservoir 214 decreases the pressure therein (i.e., increases back pressure). When the back pressure in the reservoir 214 reaches a threshold value, it is sufficient to draw an air bubble through the active bubble generator orifice. This pressure is termed the "bubble pressure" and is principally dependent on the diameter of the active orifice and the viscosity of the ink. (Back pressures smaller than the bubble pressure are insufficient to overcome the surface tension at the ink/air interface and thus are unable to draw bubbles through the active bubble generator orifice.) The introduction of an air bubble through the active bubble generator orifice into the reservoir 214 lowers the back pressure in the reservoir 214 (and thus in the printhead 220) below the threshold value momentarily, until continued ejection of ink again brings it to the bubble pressure and another bubble is introduced. Continued printing results in the periodic introduction of bubbles, causing the volume of air in the reservoir 214 to increase. During this "steady state" printing condition, the back pressure in the reservoir 214 oscillates in a closely bounded range about the bubble pressure. By providing orifices of different diameters, the back pressure control unit 210 is thus able to selectively set the back pressure in the reservoir 214 and the printhead 220 to one of three possible back pressure settings. While the illustrated example provides three back pressure settings, it should be noted that additional back pressure settings could be made available by providing additional orifices of different diameters.

While specific embodiments of the present invention have been described, it will be apparent to those skilled in the art that various modifications thereto can be made without departing from the spirit and scope of the invention as defined in the appended claims. Other embodiments for providing back pressure modulation are possible. For instance, back pressure modulation could also be accomplished with an inkjet pen with two or more different foam chambers having different pressures or two or more different banks of supplies having different pressures.

What is claimed is:

1. A printing system comprising:

an ink supply;

a printhead fluidly connected to said ink supply, said printhead including a plurality of ink ejection nozzles;

a plurality of pressure chambers, each configured to maintain a different back pressure during printing operations; and a valve between said pressure chambers and said printhead, wherein said valve selectively couples one of said pressure chambers to said printhead to control a back pressure in said printhead based on a current print mode.

2. The printing system of claim 1 further comprising a controller for controlling said valve.

3. The printing system of claim 1 wherein said means for controlling meniscus condition comprises a pressure chamber fluidly connected to said ink supply and in fluid communication with said printhead, and a pump fluidly connected to said pressure chamber, wherein said pump pumps ink out of said pressure chamber to increase back pressure in said pressure chamber and said pressure chamber receives ink from said ink supply to decrease back pressure in said pressure chamber.

4. The printing system of claim 3 further comprising a controller for controliing the flow of ink in and out of said pressure chamber.

5. The printing system of claim 4 further comprising a pressure sensor for sensing pressure in said pressure chamber, said pressure sensor providing a signal indicative of pressure in said pressure chamber to said controller.

6. The printing system of claim 1 further comprising an inkjet pen containing said plurality of pressure chambers, said valve, and a local ink reservoir located in said inkiet pen and fluidly connected to said ink supply, wherein said printhead is mounted on said inkiet pen so as to be in fluid communication with said local ink reservoir.

7. The printing system of claim 6 wherein said means for controlling meniscus condition comprises first and second air bags selectively vented to the atmosphere external of said inkjet pen, wherein ink from said ink supply is admitted into said local ink reservoir when said first air bag is vented and back pressure reaches a first set point and wherein ink from said ink supply is admitted into said local ink reservoir when said second air bag is vented and back pressure reaches a second set point.

8. The printing system of claim 6 wherein said printhead is mounted on said inkjet pen and said ink supply is located in said inkjet pen.

9. The printing system of claim 8 wherein said means for controlling meniscus condition comprises a multiple orifice bubble generator having orifices of different diameters, wherein said bubble generator can be selectively positioned so that only one of said orifices at a time establishes a fluid path between said ink supply and the atmosphere external to said inkjet pen.

10. A printing system capable of operating in a number of distinct print modes, said printing system comprising:

an ink supply;

an inkjet pen including a printhead in fluid communication with said ink supply;

a plurality of pressure chambers disposed within said inkjet pen, each configured to maintain a different back pressures during printing operations; and means for selectively placing one of said pressure chambers at a time in fluid communication with said printhead, wherein one of said pressure chambers is placed in fluid communication with said printhead when said printing system is operating in a first print mode and another of said pressure chambers is placed in fluid communication with said printhead when said printing system is operating in a second print mode.

11. The printing system of claim 10 wherein said means for selectively placing one of said pressure chambers at a time in fluid communication wit said printhead comprises a valve connected between said pressure chambers and said printhead, wherein each pressure chamber is fluidly connected to said ink supply.

12. The printing system of claim 11 fUrther comprising a controller for controlling said valve.

13. The printing system of claim 10 wherein said means for setting back pressure comprises a pressure chamber fluidly connected to said ink supply and in fluid communication with said printhead, and a pump fluidly connected to said pressure chamber, wherein said pump pumps ink out of said pressure chamber to increase back pressure in said pressure chamber and said pressure chamber receives ink from said ink supply to decrease back pressure in said pressure chamber.

14. The printing system of claim 13 further comprising a controller for controlling said the flow of ink in and out of said pressure chamber.

15. The printing system of claim 14 further comprising a pressure sensor for sensing pressure in said pressure chamber, said pressure sensor providing a signal indicative of pressure in said pressure chamber to said controller.

16. The printing system of claim 10 further comprising a local ink reservoir located in said inkjet pen, said printhead being in fluid communication with said local ink reservoir, and wherein said means for setting back pressure comprises first and second air bags selectively vented to the atmosphere external of said inkjet pen, wherein ink from said ink supply is admitted into said local ink reservoir when said first air bag is vented and back pressure reaches a first set point, and wherein ink from said ink supply is admitted into said local ink reservoir when said second air bag is vented and back pressure reaches a second set point.

17. The printing system of claim 10 wherein said ink supply is located in said inkjet pen and said means for setting back pressure comprises a multiple orifice bubble generator having orifices of different diameters, wherein said bubble generator can be selectively positioned so that only one of said orifices at a time establishes a fluid path between said ink supply and the atmosphere external to said inkjet pen.

18. An inkjet pen comprising:

a body defining an ink reservoir;

a printhead mounted to an outer surface of said body in fluid communication with said ink reservoir; and a back pressure control unit having multiple back pressure settings disposed in said body;

wherein said back pressure control unit comprises a plurality of pressure chambers each of which is configured to maintain a different back pressure during printing operations, said back pressure control unit being configured to selectively place one of said pressure chambers at a time in fluid communication with said printhead.

19. The inkjet pen of claim 18 wherein said back pressure control unit comprises:

first and second air bags disposed in said body;

means for selectively venting one of said first and second airbags at a time to the atmosphere external of said body; and a valve lever pivotally mounted in said body and abutting said first and second air bags, wherein when said first air bag is vented, increasing back pressure wiU cause said first bag to expand and exert a force against said valve lever so that a first ink inlet wiU be opened to admit ink into said ink reservoir when back pressure reaches a first set point, and when said second air bag is vented, increasing back pressure will cause said second bag to expand and exert a force against said valve lever so tat a second ink inlet will be opened to admit ink into said ink reservoir when back pressure reaches a second set point.

20. The inkjet pen of claim 18 wherein said back pressure control unit comprises:

first and second air bags disposed in said body;

means for selectively venting one of said first and second airbags at a time to the atmosphere external of said body;

a first valve lever pivotally mounted in said body and abutting said first air bag, wherein when said first air bag is vented, increasing back pressure will cause said first bag to expand and exert a force against said first valve lever so that a first ink inlet will be opened to admit ink into said ink reservoir when back pressure reaches a first set point and a second valve lever pivotally mounted in said body and abutting said second air bag, wherein when said second air bag is vented, increasing back pressure will cause said second bag to expand and exert a force against said second valve lever so that a second ink inlet will be opened to admit ink into said ink reservoir when back pressure reaches a second set point.

21. The inkiet pen of claim 18 wherein said back pressure control unit comprises a cylinder rotatively mounted in said body, said cylinder having multiple orifices of different diameters formed therein, and wherein said cylinder can be rotated so that only one of said orifices at a time establishes a fluid path between said ink reservoir and the atmosphere external to said body.

22. A method of inkjet printing in a number of distinct print modes, said method comprising:

providing a printhead;

supplying ink to said printhead;

establishing a back pressure in said printhead, wherein said back pressure corresponds to a desired print mode; and changing said back pressure in response to a change in print mode by selectively placing said printhead in fluid commnunication with one of a plurality of pressure chambers each of which is configured to maintain a different back pressure during printing operations.

23. The method of claim 22 further comprising changing print mode between print jobs.

24. The method of claim 22 further comprising changing print mode during a print job.

* * * * *

UNITED STATES PATENT AND TRADEMARK OFFICE

CERTIFICATE OF CORRECTION

PATENT NO. : 7,467,858 B2
APPLICATION NO. : 11/248907
DATED : December 23, 2008
INVENTOR(S) : Hector J. Lebron et al.

It is certified that error appears in the above-identified patent and that said Letters Patent is hereby corrected as shown below:

In column 10, line 64, in Claim 4, delete “controliing” and insert -- controlling --, therefor.

In column 11, line 5, in Claim 6, delete “inkiet” and insert -- inkjet --, therefor.

In column 11, line 7, in Claim 6, delete “inkiet” and insert -- inkjet --, therefor.

In column 11, line 14, in Claim 7, after “point” insert -- , --.

In column 11, line 47, in Claim 11, delete “wit” and insert -- with --, therefor.

In column 11, line 51, in Claim 12, delete “fUrther” and insert -- further --, therefor.

In column 11, line 62, in Claim 14, after “controlling” delete “said”.

In column 12, line 40, in Claim 19, delete “wiU” and insert -- will --, therefor.

In column 12, line 42, in Claim 19, delete “wiU” and insert -- will --, therefor.

In column 12, line 46, in Claim 19, delete “tat” and insert -- that --, therefor.

In column 12, line 60, in Claim 20, after “point” insert -- ; --.

In column 13, line 1, in Claim 21, delete “inkiet” and insert -- inkjet --, therefor.

In column 14, lines 4-5, in Claim 22, delete “comnmunication” and insert -- communication --, therefor.

Signed and Sealed this

Fourteenth Day of April, 2009

JOHN DOLL
*Acting Director of the United States Patent and Trademark Office*